US008839774B1

(12) United States Patent
Torbett

(10) Patent No.: US 8,839,774 B1
(45) Date of Patent: Sep. 23, 2014

(54) COUPLER FOR ATTACHING AN ARCHERY BOW TO AN ADJUSTABLE FIREARM SHOOTING SUPPORT

(75) Inventor: Charlton Rhodes Torbett, Watkinsville, GA (US)

(73) Assignee: Sta-Bow-Lizer, LLC, Watkinsville, GA (US)

( * ) Notice: Subject to any disclaimer, the term of this patent is extended or adjusted under 35 U.S.C. 154(b) by 177 days.

(21) Appl. No.: 13/429,979

(22) Filed: Mar. 26, 2012

(51) Int. Cl.
*F41B 5/14* (2006.01)

(52) U.S. Cl.
USPC ..... 124/88

(58) Field of Classification Search
USPC ..... 124/88; 42/94, 1.07
See application file for complete search history.

(56) References Cited

U.S. PATENT DOCUMENTS 7,434,773 B1 * 10/2008 Minjares ..... 248/181.1
2010/0018512 A1 * 1/2010 Sandel ..... 124/25.6

* cited by examiner

*Primary Examiner* — Gene Kim
*Assistant Examiner* — Amir Klayman
(74) *Attorney, Agent, or Firm* — Smith Risley Tempel Santos LLC; Matthew T. Hoots

(57) ABSTRACT

A coupler for interconnecting an archery bow and an adjustable firearm shooting support includes a housing with an actuator lever and a lower actuator extending respectively therefrom and being pivotally interconnected to opposite ends of a linkage. The firearm support is vertically adjustable and activated by a trigger mechanism whereby activation of the actuator lever causes the lower actuator to pivot outwardly into contact with the firearm support trigger to allow vertical adjustability of the bow and whereby deactivation of the actuator lever stabilizes movement of the bow into a support or rest position.

5 Claims, 11 Drawing Sheets

COUPLER FOR ATTACHING AN ARCHERY BOW TO AN ADJUSTABLE FIREARM SHOOTING SUPPORT

BACKGROUND OF THE INVENTION

This invention provides archers with the ability to aim more accurately by adjusting the supported aiming point while at full draw. In any shooting sport, accuracy is the principal objective of the shot. Whether shooting a rifle, pistol or any type of traditional archery equipment, a supported shot is always more accurate than one made freehand or otherwise unsupported. When sighting a rifle, the shooter will typically set up some type of rest or shooting bench to prevent movement of the firearm. When hunting, the hunter will attempt to find some type of natural rest such as a tree limb, stump or rock or utilize a commercial support device to support the firearm prior to making a kill shot.

For years manufacturers have produced commercial firearm shooting support products to address the need for accuracy when target shooting or hunting. There are some very rudimentary devices for traditional archery, but none gives the archer the ability to adjust the aiming point while at full draw. The Coupler for Attaching an Archery Bow to an Adjustable Firearm Shooting Support addresses this very important need by giving the archer the ability to make sight alignment adjustments for a supported shot while at full draw.

The most common archery aiming sight setup consists of one to six aiming pins, aligned either vertically or horizontally, and mounted in the sight window of the bow, just above the handgrip, and a second aiming point mounted on the bow string at the point where the string comes closest to the archer's aiming eye while at full draw. The string mounted device, commonly called a peep sight, is usually a round or oval shaped disc with a hole in its center that is mounted on the string by evenly separating the strands of the string, inserting the disc and tying it off at the top and bottom, as depicted in FIG. 5. When the two sights are properly adjusted, the archer should be able to line up the selected front pin with the target while looking through the string-mounted peep sight at full draw. This front to rear alignment is the same concept used with firearms with one sight mounted at the muzzle on the barrel and one sight mounted at the breech end of the barrel in front of the shooter's aiming eye. When both sights are aligned with the target, accuracy is greatly improved.

Alignment is relatively simple with a firearm when using a shooting support or shooting stick. Aiming adjustments are easy with a firearm because once the firearm is supported at the forearm or muzzle end, only one hand is needed to hold the weapon secure at the butt end thereby leaving the other hand free to adjust the shooting rest up, down, right or left, as needed, to align with the target. Even after cocking the weapon, the characteristics of the front and rear sights do not change. In other words, there is no difference in aiming a firearm that is cocked and ready to shoot versus one that is not.

This is not true for traditional archery. The front and rear sights on a bow are not aligned when the bow is not at full draw. Target and sight alignment cannot be achieved until the bow is at full draw. In order to cock or pull the bow, both of the archer's hands are required throughout release of the arrow toward the target. Holding a firearm in the cocked position is performed by a mechanical, spring-loaded device inside the weapon. With a bow, the archer's hands and arms perform this function. Since both hands are required to hold the bow at full draw, which is the only position where sight alignment can occur, as shown by the arrow in FIG. 6, it is impossible to make full draw sight adjustments from a supported shooting position because one hand would have to be removed from either the bow handle or the string to make an adjustment to the support. This would cause full draw to be lost or would uncock the bow and make the shot impossible, as shown by the arrow in FIG. 7. This is where the Coupler for Attaching an Archery Bow to an Adjustable Firearm Shooting Support is unique, because with prior shooting support configurations, supported full draw sighting adjustments are not possible.

With the Coupler for Attaching an Archery Bow to an Adjustable Firearm Shooting Support, the archer can easily make fluid and smooth sighting adjustments while at full draw, never removing either hand from the bow or the string. This gives the archer a virtually unlimited and supported vertical and horizontal range of movement for sight adjustment with the ability to make supported shots that are exponentially more accurate.

BRIEF SUMMARY OF THE INVENTION

A coupler for interconnecting an archery bow with an adjustable firearm shooting support wherein the firearm support is vertically adjustable by activation of a trigger mechanism. The coupler includes a housing with an actuator lever extending generally upwardly from the housing and a lower actuator extending generally downwardly from the housing both of which are pivotally connected to the housing. A linkage pivotally interconnected at one end to the actuator lever and at the other end to the lower actuator. The coupler interconnects an archery bow and the firearm support such that at full draw of the archery bow activation of the actuator lever causes the lower actuator to rotate outwardly of the housing so that it comes into contact with the trigger mechanism of the adjustable firearm shooting support allowing selective vertical adjustment of the bow until the actuator lever is released which terminates vertical movement of the firearm support, locking it in place to provide the desired supported position for the bow.

DETAILED DESCRIPTION OF THE INVENTION

Figure 1:
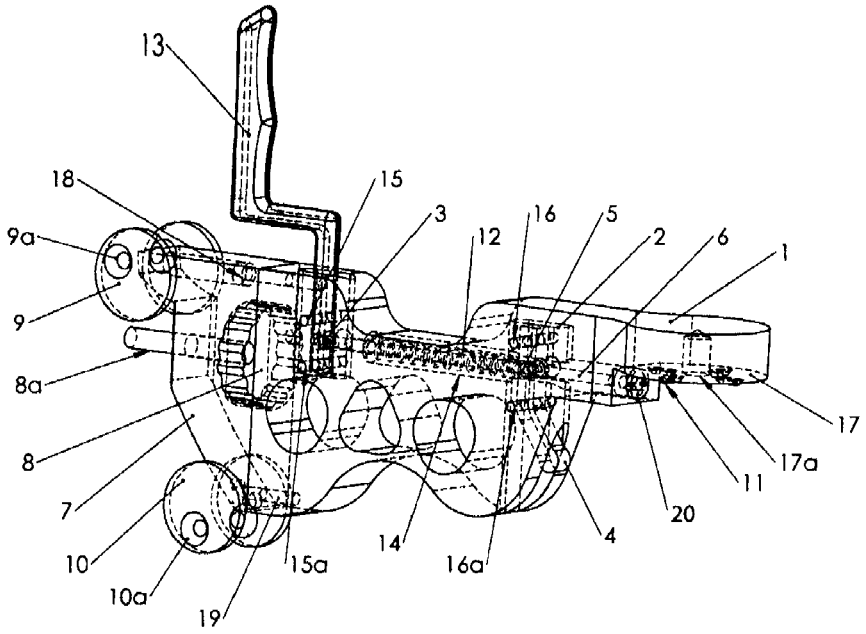
FIG. 1 is a transparent perspective view of the Coupler for Attaching an Archery Bow to an Adjustable Firearm Shooting Support according to this invention.
Figure 2:
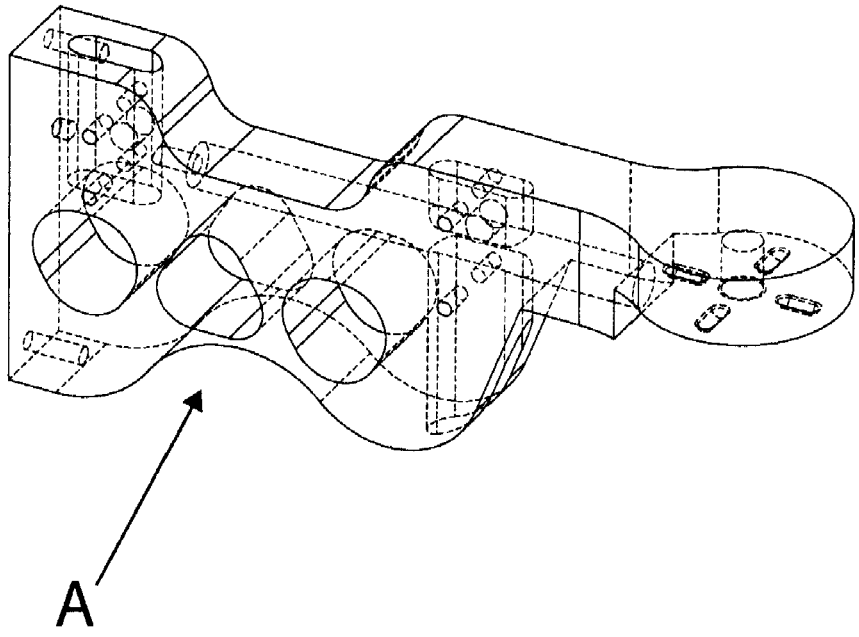
FIG. 2 is a transparent perspective view of the actuator housing.
Figure 3:
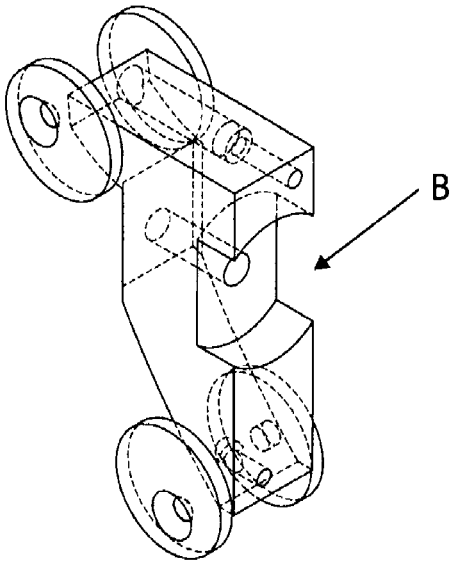
FIG. 3 is a transparent perspective view of the adapter housing.
Figure 4:
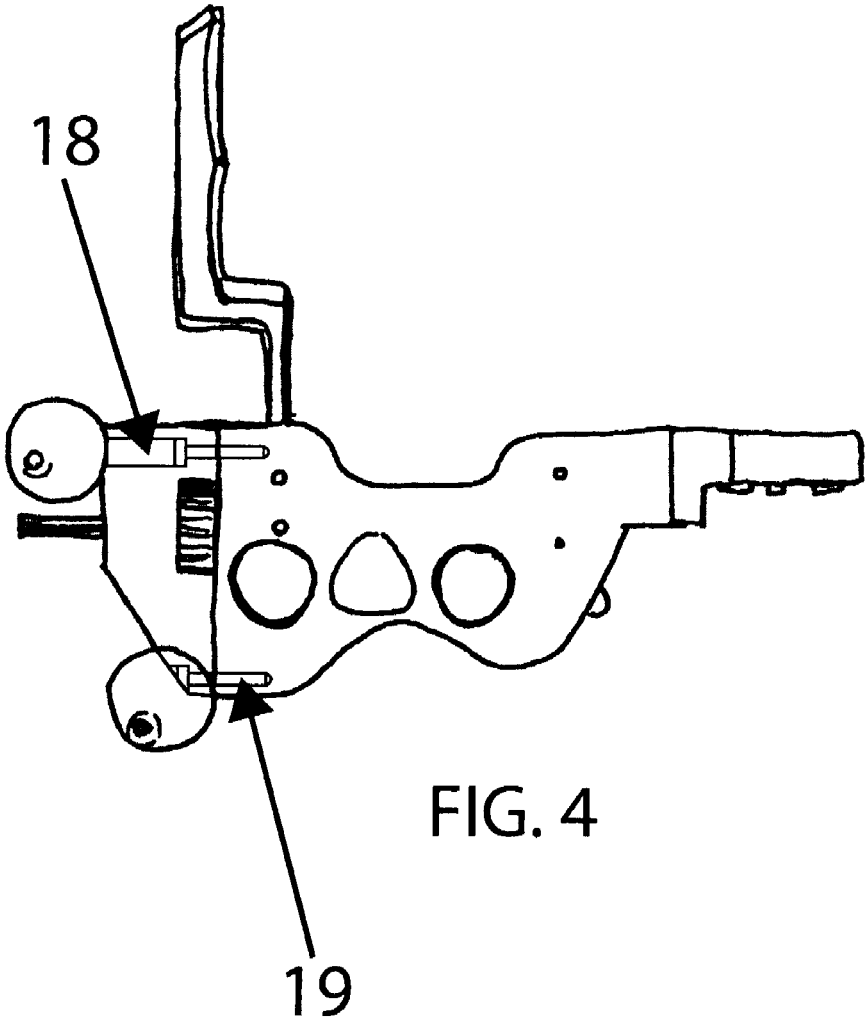
FIG. 4 is a transparent side view of the body of the Coupler for Attaching an Archery Bow to an Adjustable Firearm Shooting Support.
Figure 5:
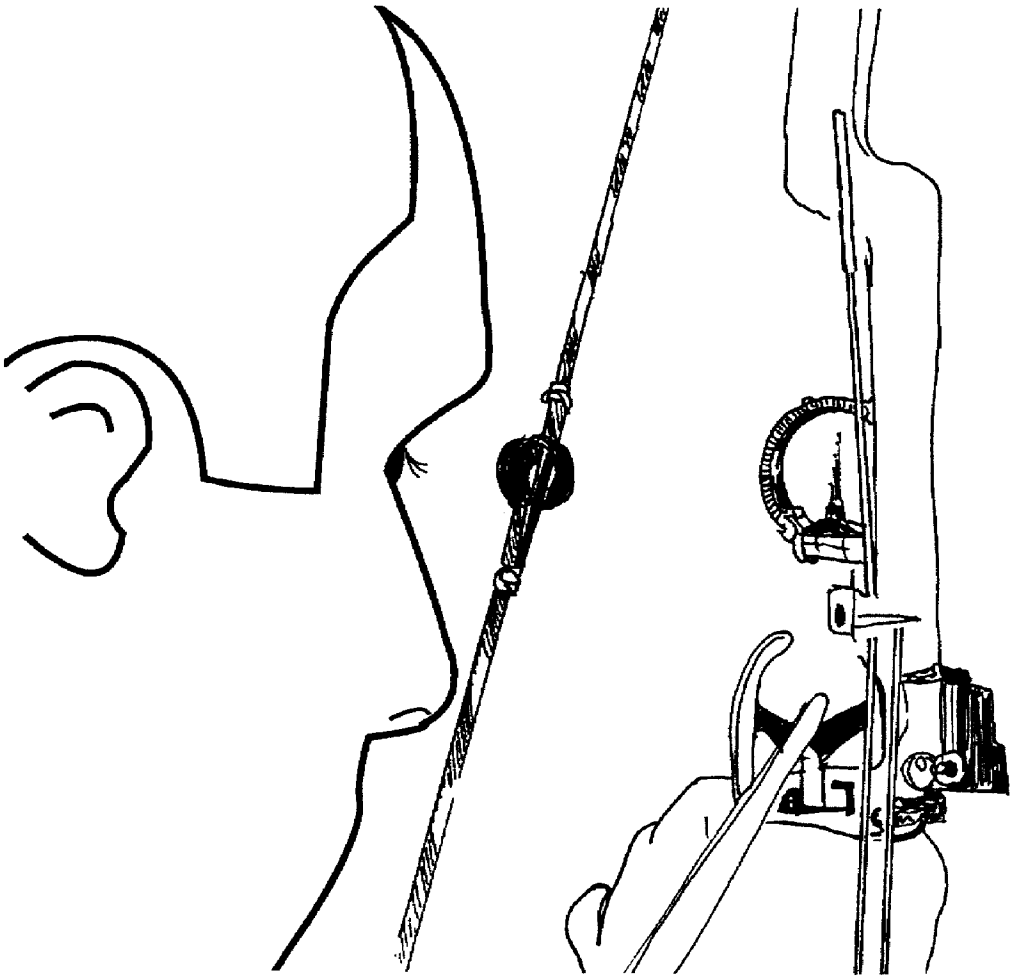
FIG. 5 illustrates the archery bow sights.
Figure 6:
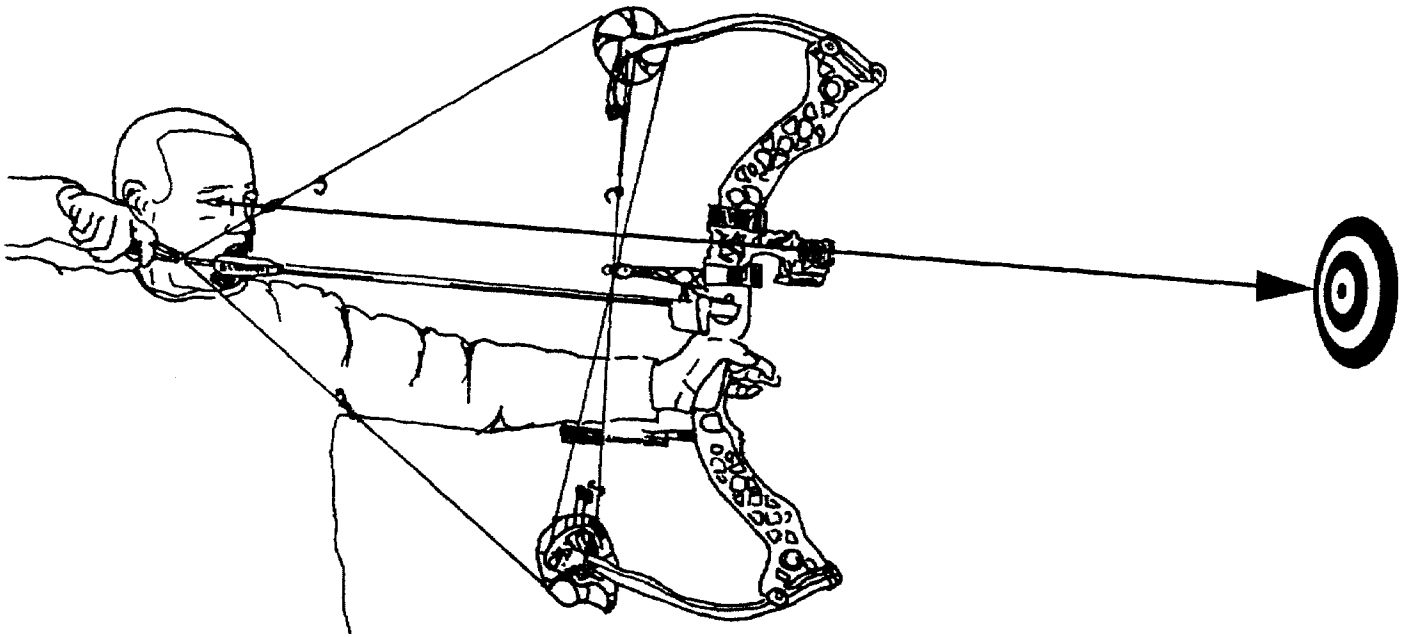
FIG. 6 shows the alignment of the front and rear sights at full draw.
Figure 7:
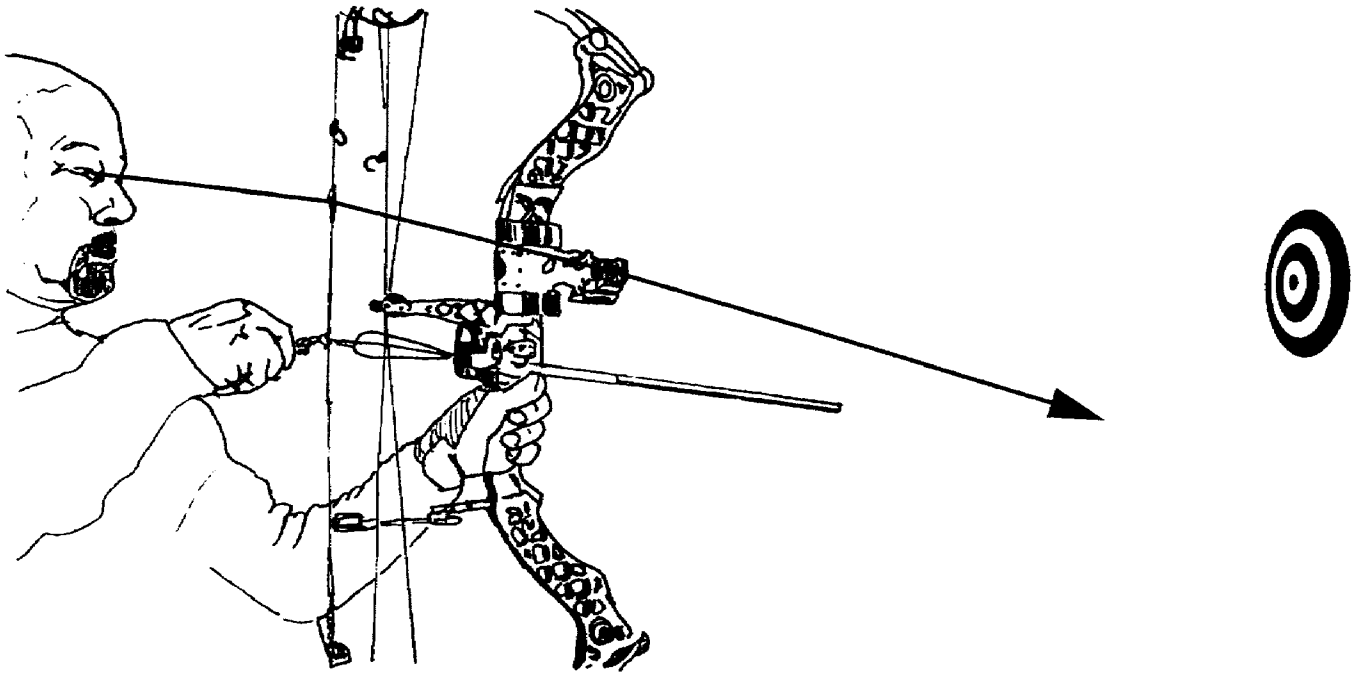
FIG. 7 shows the inability to align the front and rear sights while not at full draw.
Figure 8:
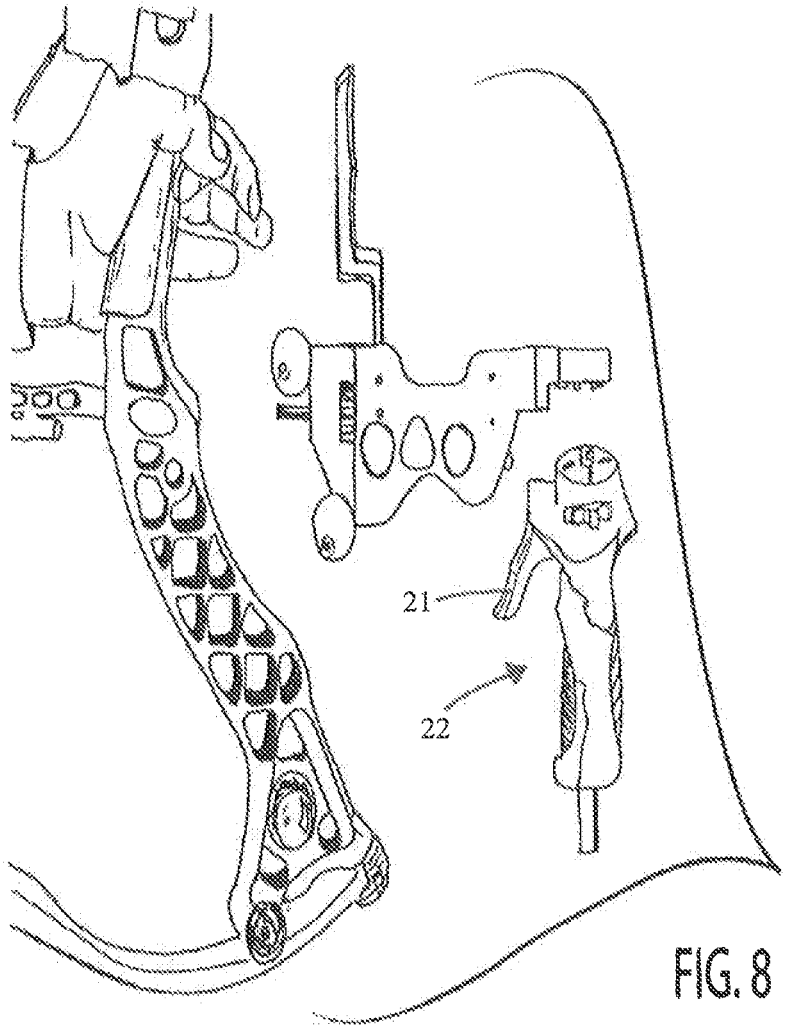
FIG. 8 is a partially exploded view showing the Coupler for Attaching an Archery Bow to an Adjustable Firearm Shooting Support, an archery bow and adjustable firearm shooting support.
Figure 9:
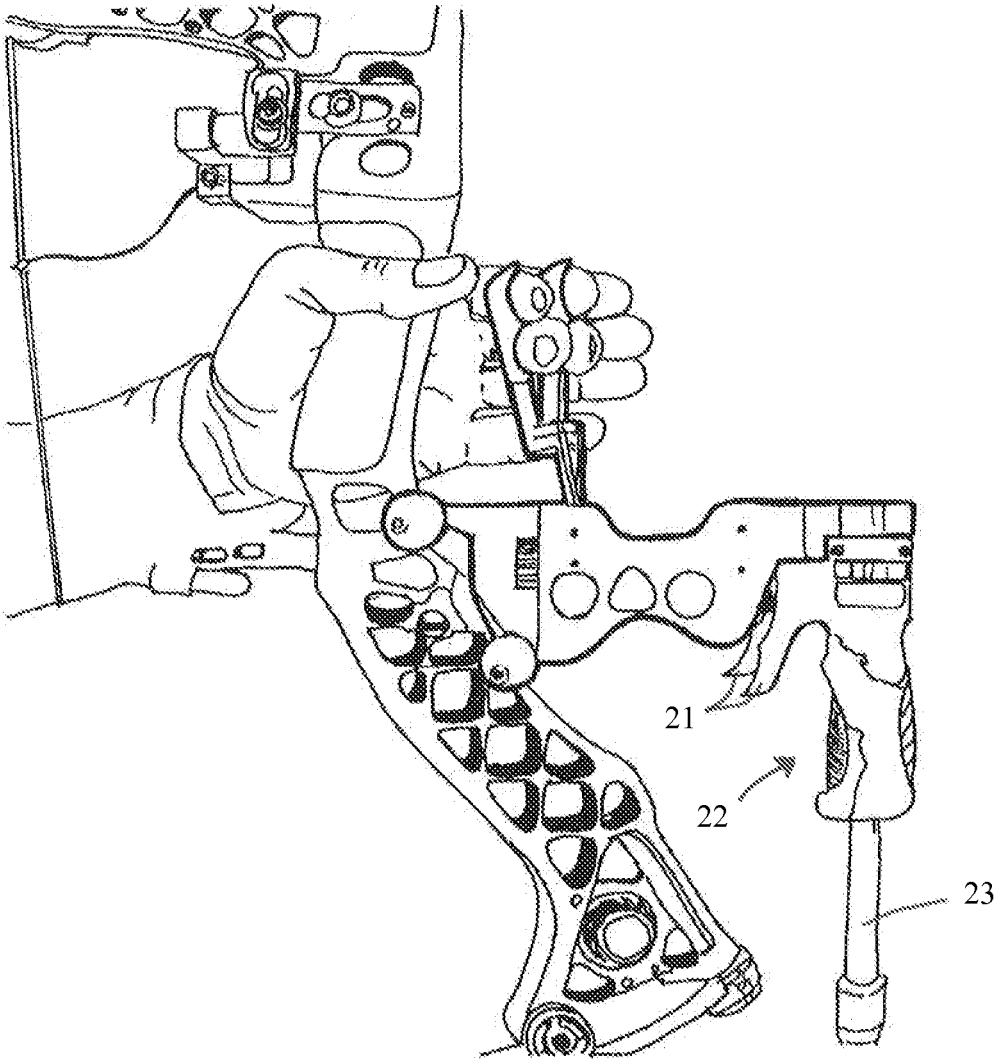
FIG. 9 shows the Coupler for Attaching an Archery Bow to an Adjustable Firearm Shooting Support secured to a bow and to the firearm shooting support.

The Coupler for Attaching an Archery Bow to an Adjustable Firearm Shooting Support, according to this invention, includes two main housings, i.e., an actuator housing identified generally by the letter A in FIG. 2 and an adapter housing identified generally by the letter B in FIG. 3. The two housings A and B are connected by two screws 18 and 19, shown in FIGS. 1 and 4, one upper and one lower, which are accessed from the bow side of adapter housing B.

Actuator housing A internally includes actuator connecting linkage 6, actuator return spring 12, actuator lever 13 and lower actuator 4, upper pivot pins 15 and 16 and lower pivot pins 15*a* and 16*a*. Only two pins will be in use at a time, depending on whether lower actuator 4 is pushing or pulling. Pivot pins 15 and 15*a* are dowel pins, each which acts independently as an axle for actuator lever 13 for purposes of rotation. Pivot pins 15 and 15*a* are affixed to actuator housing A and actuator lever 13 is held in place by pivot pins 15 and 15*a* which are used alternatively depending on the requirements of the adjustable firearm shooting support as to whether activating the firearm shooting support requires a pushing or pulling action to obtain vertical adjustment.

Actuator housing A also includes upper connecting axle 3 which is pivotally interconnected to actuator lever 13 and lower connecting axle 5 which is pivotally interconnected to lower actuator 4. Spring 12 is disposed in return spring retaining barrel 14. Connecting linkage 6 also includes an adjustable firearm shooting support internal interface 20 located at the shooting support end of actuator housing A for the purpose of internally activating the vertical adjustability feature of the firearm shooting support.

Currently, the only adjustable firearm shooting support on the market is the Primos Trigger Stick and this invention is designed to complement this particular shooting support. When interfacing with the Primos Trigger Stick, the Coupler for Attaching an Archery Bow to an Adjustable Firearm Shooting Support will push the trigger of the Primos Trigger Stick when upper actuator lever 13 is activated. Pivot pin 15*a* is not used in conjunction with the Primos Trigger Stick, but is available if needed for other adjustable firearm shooting devices as they become available in the future.

Externally, actuator housing A includes openings, upper and lower, where actuator lever 13 and lower actuator 4 protrude from the housing. In addition, multiple detent connecting points 11 are formed on the support end of actuator housing A and are either concave or convex, as needed to connect to the adjustable firearm shooting support. Also, at the bottom of the support end of actuator housing A, threaded port 17*a* is disposed in the center of detents 11 for connection to the firearm shooting support.

Internally, adapter housing B includes thumb wheel 8 with threaded connecting shaft 8*a* which extends outwardly for connection to the archery bow. Adapter housing B externally features upper and lower antitwist anchoring discs 9 and 10 on both the right and left side which attach to the bow below the handle by means of antitwist anchoring fasteners 9*a* and 10*a* which pass through the riser of the bow and screw into threaded ports in the antitwist anchoring discs on the opposite side of the bow riser. The specific location depends on the make and model of the bow.

The Coupler for Attaching an Archery Bow to an Adjustable Firearm Shooting Support connects to the adjustable firearm shooting support by first removing the V-shaped firearm adapter from the top of the support and attaching the Coupler for Attaching an Archery Bow to an Adjustable Firearm Shooting Support by using the thumb screw on the adjustable firearm support 22 to screw into threaded port 17*a*. Detents 11 that surround threaded port 17*a* help to secure the Coupler for Attaching an Archery Bow to an Adjustable Firearm Shooting Support to the firearm shooting rest and prevent twisting during operation. Attachment is achieved by interconnection of threaded port 17*a* and manipulation of the thumb screw incorporated into adjustable firearm support 22. The thumb screw should be manually tightened as tight as is possible without using any tools. The archer must ensure that detents formed on the adjustable firearm support 22 line up with and engage with detents 11 on the Coupler for Attaching an Archery Bow to an Adjustable Firearm Shooting Support. This will also prevent twisting during operation.

Figure 10:
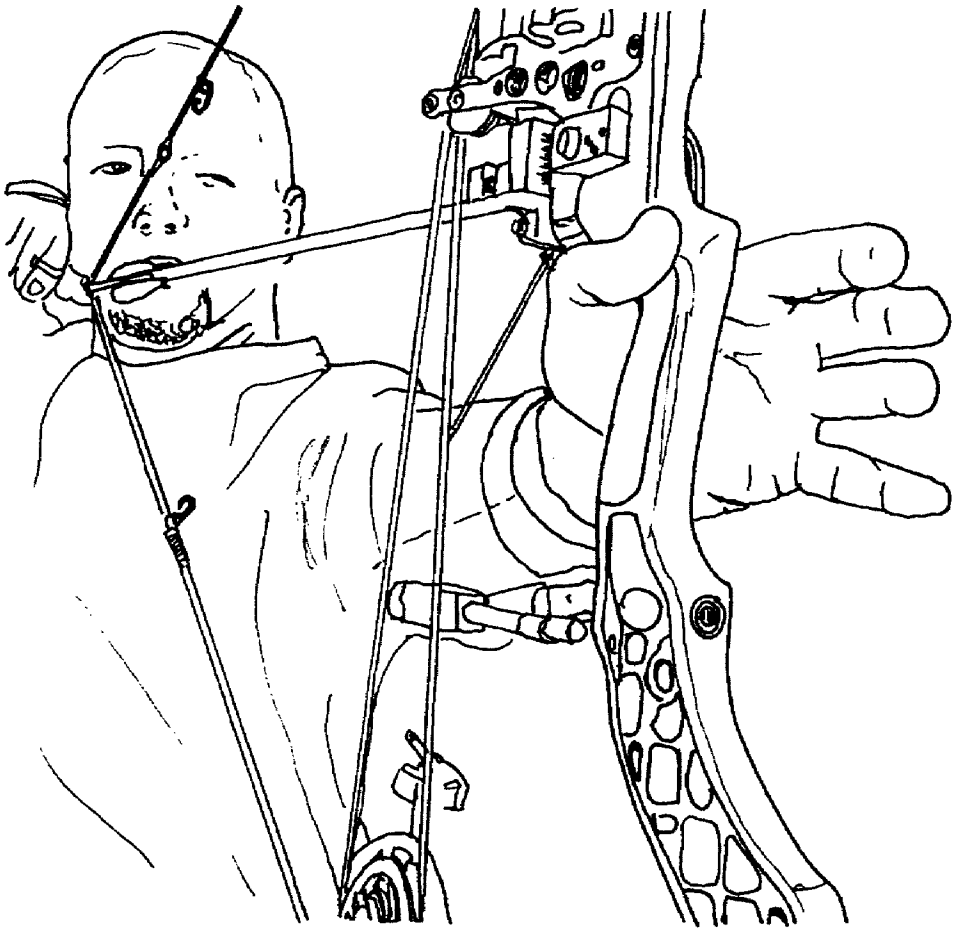
FIG. 10 shows the webbed space between the archer's thumb and index finger.

In operation, at full draw, the archer first reaches forward with the index and middle fingers on the forward or support hand, while the tension of the bow is held forward by allowing the bow to rest in the webbed space of the palm, between the thumb and index finger, as shown in FIG. 10. Then the index and middle fingers are curled around upper actuator lever 13 and the archer gently pulls actuator lever 13 toward the bow which causes actuator lever 13 to rotate on pivot pin 15 which causes linkage 6 to move forward away from the bow. As this occurs, the movement of linkage 6 causes lower actuator 4 to rotate on pivot pin 16 through the interconnection between lower actuator 4, connecting axle 5 and linkage 6.

Figure 11:
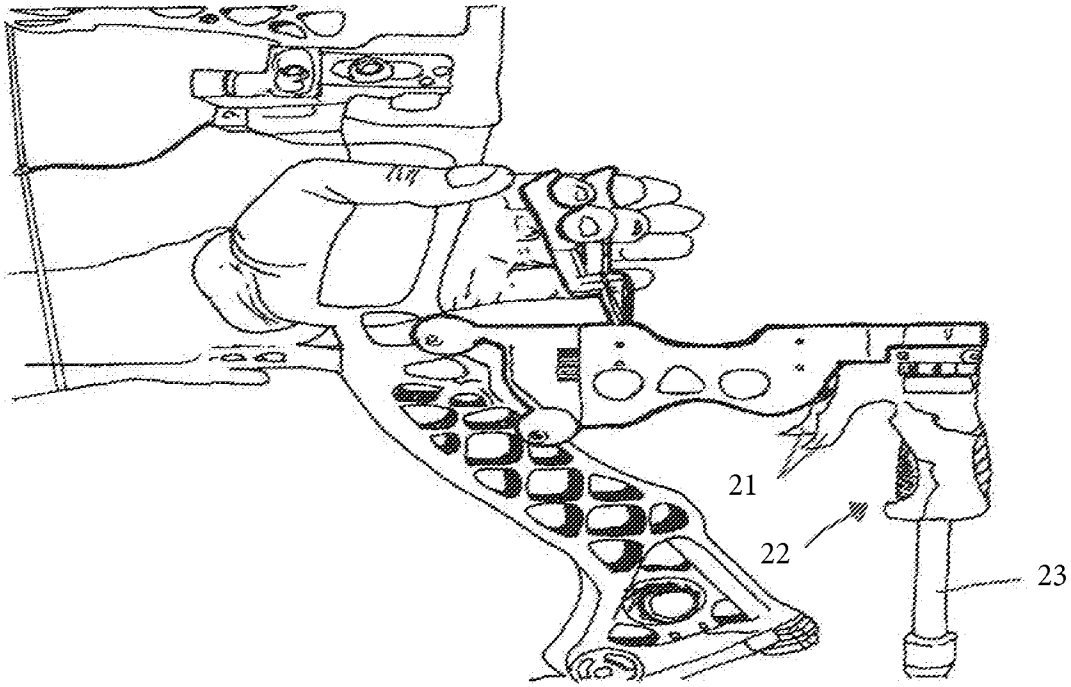
FIG. 11 is an enlarged view showing the archer's index and middle finger pulling the upper actuator according to this invention.

As lower actuator 4 extends outwardly from actuator housing A, it pushes trigger 21 of adjustable firearm support 22, as shown in FIG. 11. This action in turn releases vertical rod 23 of adjustable firearm support 22 allowing the bow to move up and down and into the desired shooting position.

Once target and sight alignment is achieved, actuator lever 13 is released and spring 12 causes linkage 6 to withdraw causing lower actuator 4 to move away from trigger 21 thereby locking adjustable firearm shooting support 22 in position. The process of sight adjustment is repeated until alignment is perfect. Now the arrow can be released toward the target from a rest or supported position with much greater accuracy than from a nonsupported position. Accuracy is not the only benefit of being able to make full draw sighting adjustments. The lack of movement during the sighting process also saves time by decreasing the number of shots necessary to effectively sight in the bow as well as giving the archer much more confidence in the accuracy of the sight alignment process because he knows the bow was not moving during sighting since the shots were made from a supported or rest position.

The invention claimed is:

1. An archery bow coupler for attaching an archery bow to an adjustable firearm shooting support, comprising:

an adapter configured to mount on a riser of an archery bow such that the archery bow coupler is positioned ahead of the archery bow relative to an archer using the archery bow;

a support component comprising a threaded port for mechanically connecting the archery bow coupler to a top mounting plate of a height adjustable firearm shooting support; and an actuator housing disposed between the adapter and the support component, the actuator housing comprising:

a first actuator lever pivotally connected to the actuator housing and extending upwardly and outwardly therefrom such that it is positioned above a plane defined by the support component when the archery bow coupler is mounted on a riser of an archery bow;

a second actuator lever pivotally connected to the actuator housing and extending downwardly and outwardly therefrom such that it is positioned below a plane defined by the support component when the archery bow coupler is mounted on a riser of an archery bow; and a linkage contained within the actuator housing, wherein the linkage is pivotally connected to the first actuator lever at one end and to the second actuator lever at the other end;

wherein actuation of the first actuator lever amplifies an actuation force and, via the linkage, causes actuation of the second actuator lever to apply a horizontal force on an externally accessible actuation mechanism of a height adjustable firearm shooting support;

wherein the adapter is located at one end of the actuator housing; and wherein the support component extends from an end of the actuator housing that is distal to the end where the adapter is located.

2. A coupler according to claim 1, wherein the adapter is configured to mount on the riser by threadably interconnecting to a threaded stabilizer port.

3. A coupler according to claim 1, further comprising a pair of spaced antitwist discs interconnected to the adapter and disposed to mechanically interface with either side of an archery bow.

4. A coupler according to claim 1, wherein the first actuator lever is pivotally connected to the actuator housing by means of a first pivot pin.

5. A coupler according to claim 4, further comprising a second pivot pin interconnected to the actuator housing and spaced from the first pivot pin.

* * * * *